US011763772B2

(12) United States Patent
Zou et al.

(10) Patent No.: US 11,763,772 B2
(45) Date of Patent: Sep. 19, 2023

(54) DISPLAY PANEL AND DISPLAY DEVICE FOR ADJUSTING IMPEDANCE

(71) Applicant: Xiamen Tianma Micro-Electronics Co., Ltd., Xiamen (CN)

(72) Inventors: Zongjun Zou, Xiamen (CN); Ying Sun, Xiamen (CN); Yumin Xu, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 56 days.

(21) Appl. No.: 17/621,700

(22) PCT Filed: Jan. 28, 2021

(86) PCT No.: PCT/CN2021/074032

§ 371 (c)(1),
(2) Date: Dec. 22, 2021

(87) PCT Pub. No.: WO2022/126835

PCT Pub. Date: Jun. 23, 2022

(65) Prior Publication Data

US 2022/0398992 A1 Dec. 15, 2022

(30) Foreign Application Priority Data

Dec. 18, 2020 (CN) ..... 202011503062.6

(51) Int. Cl.
*G09G 5/00* (2006.01)

(52) U.S. Cl.
CPC ..... *G09G 5/006* (2013.01); *G09G 2310/0286* (2013.01); *G09G 2310/08* (2013.01); *G09G 2330/06* (2013.01)

(58) Field of Classification Search
CPC ..... G09G 5/006
See application file for complete search history.

(56) References Cited

U.S. PATENT DOCUMENTS 10,620,676 B1 4/2020 Tejada et al.
2010/0214206 A1 8/2010 Yokoyama et al.
(Continued)

FOREIGN PATENT DOCUMENTS

CN 1790473 A 6/2006
CN 100377196 C 3/2008
(Continued)

*Primary Examiner* — Gustavo Polo
(74) *Attorney, Agent, or Firm* — KILPATRICK TOWNSEND & STOCKTON, LLP

(57) ABSTRACT

Provided are a display panel and a display device. The display panel includes a gate drive circuit, a plurality of impedance regulation circuits and a control module. The gate drive circuit includes a plurality of cascaded first shift registers. The plurality of cascaded first shift registers are electrically connected to a plurality of scanning lines in one to one correspondence; and the plurality of impedance regulation circuits are in one-to-one correspondence with the plurality of scanning lines. Each of the plurality of impedance regulation circuits is in series connection between a first shift register corresponding to the each of the plurality of impedance regulation circuits and a scanning line corresponding to the each of the plurality of impedance regulation circuits. The each of the plurality of impedance regulation circuits includes at least one transistor.

20 Claims, 10 Drawing Sheets

(56) References Cited

U.S. PATENT DOCUMENTS

| | | | | |
|---|---|---|---|---|
| 2010/0277458 | A1 | 11/2010 | Liu et al. | |
| 2018/0122322 | A1 | 5/2018 | Ji et al. | |
| 2019/0340969 | A1 | 11/2019 | Hu et al. | |
| 2019/0362685 | A1 | 11/2019 | Tsai et al. | |
| 2021/0074219 | A1* | 3/2021 | Hung | G09G 3/3266 |

FOREIGN PATENT DOCUMENTS

| | | | |
|---|---|---|---|
| CN | 100399386 | C | 7/2008 |
| CN | 101308705 | A | 11/2008 |
| CN | 101847375 | A | 9/2010 |
| CN | 103177681 | A | 6/2013 |
| CN | 109416902 | A | 3/2019 |
| CN | 110969999 | A | 4/2020 |
| CN | 110992863 | A | 4/2020 |

* cited by examiner

DISPLAY PANEL AND DISPLAY DEVICE FOR ADJUSTING IMPEDANCE

CROSS-REFERENCE TO RELATED APPLICATIONS

This is a National Stage Application filed under 35 U.S.C. 371 based on International Patent Application No. PCT/CN2021/074032, filed on Jan. 28, 2021, which claims priority to Chinese Patent Application No. 202011503062.6 filed on Dec. 18, 2020, disclosures of both of which are incorporated herein by reference in their entireties.

FIELD

The present disclosure relates to the field of display technologies, for example, a display panel and a display device.

BACKGROUND

With the development of display technologies, display panels are widely used in devices or scenarios that can integrate display functions, such as computers, mobile phones, wearable devices and vehicles. With the improvement of electronic device integration, pulse signals of the display panel can cause interference to other electronic products in the periphery. The interference can be referred to as Electromagnetic Interference (EMI). The electronic products subject to electromagnetic interference have a degraded performance, and even cannot work normally. Based on this, when the display panel is integrated in some devices or applied to some scenarios, for example, when the display panel is used as an onboard display screen and applied to an onboard display, the display panel generates electromagnetic interference to other onboard electronic products.

SUMMARY

The present disclosure provides a display panel and a display device so that electromagnetic interference radiated to the periphery by the display panel can be reduced.

The display panel provided includes a gate drive circuit, a plurality of impedance regulation circuits and a control module.

The gate drive circuit includes a plurality of cascaded first shift registers. The plurality of cascaded first shift registers are electrically connected to a plurality of scanning lines in one to one correspondence.

The plurality of impedance regulation circuits are in one-to-one correspondence with the plurality of scanning lines, and each of the plurality of impedance regulation circuits is in series connection between a first shift register corresponding to the each of the plurality of impedance regulation circuits and a scanning line corresponding to the each of the plurality of impedance regulation circuits. The each of the plurality of impedance regulation circuits includes at least one transistor.

The control module is electrically connected to the plurality of impedance regulation circuits and configured to adjust impedance of the at least one transistor in the each of the plurality of impedance regulation circuits.

The display device provided includes the display panel described above.

DETAILED DESCRIPTION

The solutions of the present disclosure are described hereinafter through some embodiments in conjunction with the drawings in embodiments of the present disclosure.

Figure 1:
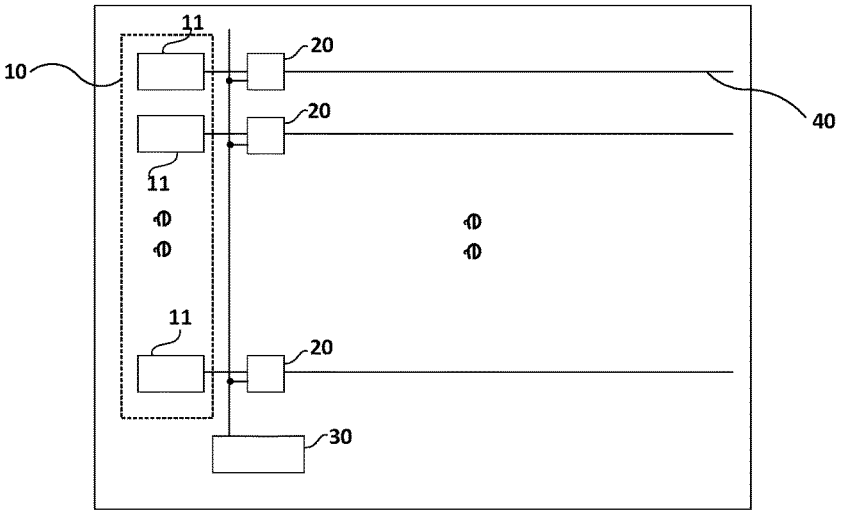
FIG. 1 is a diagram illustrating the structure of a display panel according to an embodiment of the present disclosure.

FIG. 1 is a diagram illustrating the structure of a display panel according to an embodiment of the present disclosure. As shown in FIG. 1, the display panel includes a gate drive circuit 10, a plurality of impedance regulation circuits 20 and a control module 30. The gate drive circuit 10 includes a plurality of cascaded first shift registers 11. The plurality of cascaded first shift registers 11 are electrically connected to a plurality of scanning lines 40 in one to one correspondence. Each stage of first shift register 11 is configured to provide a scanning pulse signal to a scanning line 40 correspondingly connected so that pixel units of corresponding rows can receive a data signal for display.

The plurality of impedance regulation circuits 20 are in one-to-one correspondence with the plurality of scanning lines 40. The plurality of impedance regulation circuits 20 are in series connection between the plurality of cascaded first shift registers 11 and the plurality of scanning lines 40 which are in one-to-one correspondence with each other. Each impedance regulation circuit 20 includes at least one transistor. As shown in FIG. 1, one impedance regulation circuit 20 is in series connection between each stage of first shift register 11 and a scanning line 40. The control module 30 is electrically connected to the plurality of impedance regulation circuits 20 and configured to adjust an impedance of the transistor in the impedance regulation circuits 20.

In the gate drive circuit 10, because the scanning pulse signal is provided to multi-row scanning lines 40 row by row, the scanning pulse signal is a periodic rectangular wave. The periodic rectangular wave causes electromagnetic interference of discrete spectrum. The electromagnetic interference can spread outwards through a transmission line and a space electromagnetic field, to cause problems of conduction and radiation interference, which not only seriously pollutes the surrounding electromagnetic environment, but also causes electromagnetic interference to nearby electrical equipment. The steeper the rising edge and falling edge of the waveform of the scanning pulse signal provided by the gate drive circuit 10 are, the greater the electromagnetic interference caused by the scanning pulse signals is.

In this embodiment of the present disclosure, one impedance regulation circuit 20 is in series connection between each stage of first shift register 11 and a scanning line 40. The control module 30 adjusts the impedance of the transistor in the impedance regulation circuit 20 according to different EMI requirement standards to change the waveform of the scanning pulse signal, that is, the gradient of the rising edge and the falling edge of the scanning pulse signal waveform, and achieve optimal EMI performance for electronic products with different EMI requirement standards.

In an embodiment, on the basis of the above-described embodiment, the control module 30 according to this embodiment of the present disclosure may control the turn-on and turn-off of the transistor in the impedance regulation circuit 20 to adjust the impedance of the transistor in the impedance regulation circuit 20. The impedance regulation circuit 20 according to this embodiment of the present disclosure may include at least one transistor. If the impedance regulation circuit 20 includes a plurality of transistors, the plurality of transistors may be in series, in parallel, or partly in series and partly in parallel connection. The output terminal of the control module 30 may output different level signals to control the turn-on or turn-off of the transistor in the impedance regulation circuit 20. In the following, the transistor in the impedance regulation circuit 20 is an N-type transistor as an example. For example, if the output terminal of the control module 30 is a high level, the transistor is turned on; and if the output terminal of the control module 30 is a low level, the transistor is turned off. When multiple transistors in the impedance regulation circuit 20 achieve different combinations of turn-on and turn-off, different impedance mountings of the plurality of scanning lines 40 can be obtained, so that the scanning pulse signal waveform is actively adjusted according to the EMI requirements of products, and the optimal EMI performance is achieved. In this embodiment of the present disclosure, the at least one transistor in the each of the plurality of impedance regulation circuits 20 may be an N-type transistor or a P-type transistor, which is not limited by this embodiment of the present disclosure. For example, if the transistor in the impedance regulation circuit 20 is an P-type transistor and the output terminal of the control module 30 is a low level, the transistor is turned on; and if the output terminal of the control module 30 is a high level, the transistor is turned off.

In an embodiment, the control module 30 may also adjust a gate voltage value of the transistor in the impedance regulation circuit 20 to adjust the impedance of the transistor in the impedance regulation circuit 20. The output terminal of the control module 30 may output adjustable voltage signal for controlling the switching degree of the transistor in the impedance regulation circuit 20, to achieve the adjustment of the impedance of the transistor in the impedance regulation circuit 20. For example, if the transistor in the impedance regulation circuit 20 is an N-type transistor, the voltage signal value output by the control module 30 may be increased when the rising edge and falling edge of the scanning pulse signal waveform are required to be relatively steep; and the voltage signal value output by the control module 30 may be reduced when the rising edge and falling edge of the scanning pulse signal waveform are required to be relatively slow. If the transistor in the impedance regulation circuit 20 is a P-type transistor, the voltage signal value output by the control module may be reduced when the rising edge and falling edge of the scanning pulse signal waveform are required to be steeper; and the voltage signal value output by the control module may be increased when the rising edge and falling edge of the scanning pulse signal waveform are required to be slow. In this embodiment of the present disclosure, a transistor having a relatively large linear region may be selected as the transistor in the impedance regulation circuit 20 to increase the adjustment range of the impedance of the transistor in the impedance regulation circuit 20, and ensure that the adjustment of the mounting impedance of the scanning line 40 is sufficiently flexible to achieve better EMI adjustment performance.

According to the IV characteristic formula $$I_d = \mu C_i \frac{W}{L}(|V_{gs}| - V_{th})|V_{ds}|$$

of the transistor in linear region, the smaller the slope of the IV curve is, the larger the linear region of the transistor is, and the larger the impedance adjustment range of the impedance regulation circuit 20 is. The slope of the transistor IV curve $$\mu C_i \frac{W}{L}(|V_{gs}| - V_{th}).\ \mu C_i$$

is denotes a transconductance parameter, $$\frac{W}{L}$$

denotes the channel width-to-length ratio of the transistor, $V_{gs}$ denotes the voltage difference between the gate and the source, $V_{th}$ denotes the threshold voltage of the transistor, $V_{ds}$ denotes the voltage difference between the drain and the source, and $I_d$ denotes the drain current of the transistor.

In an embodiment, on the basis of the above-described embodiment, each impedance regulation circuit 20 includes a first impedance regulation subcircuit. The first impedance regulation subcircuit includes N transistors connected in series. A gate of an i-th transistor of the N transistors in the first impedance regulation subcircuit of the impedance regulation circuit 20 are electrically connected to a same output terminal of the control module 30, where N is a positive integer greater than 1, and i is a positive integer less than or equal to N.

In the solution where a plurality of transistors in the first impedance regulation subcircuit are in series connection, the transistors may correspond to traverses when turned on, and impedances of the transistors are approximately 0. When turned off, the transistors may correspond to resistors. This embodiment of the present disclosure may use the off-impedances of multiple transistors in the first impedance regulation subcircuit to achieve the adjustment of the impedances of the impedance regulation circuit 20. The output terminal of the control module 30 may output different level signals to control the turn-on or turn-off of the transistors in the first impedance regulation subcircuit. For example, a transistor having a relatively large channel width-to-length ratio may be selected so that the impedance of the transistor is approximately 0 when the transistor is turned on, and the transistor may have a leakage current equivalent to a resistor when the transistor is turned off. It is also possible to use a case where the p-n junction of the field-effect transistor or the bipolar junction transistor (BJT) is a Schottky junction. That is, when the transistor is turned off, the channel of the transistor is not completely off.

Figure 2:
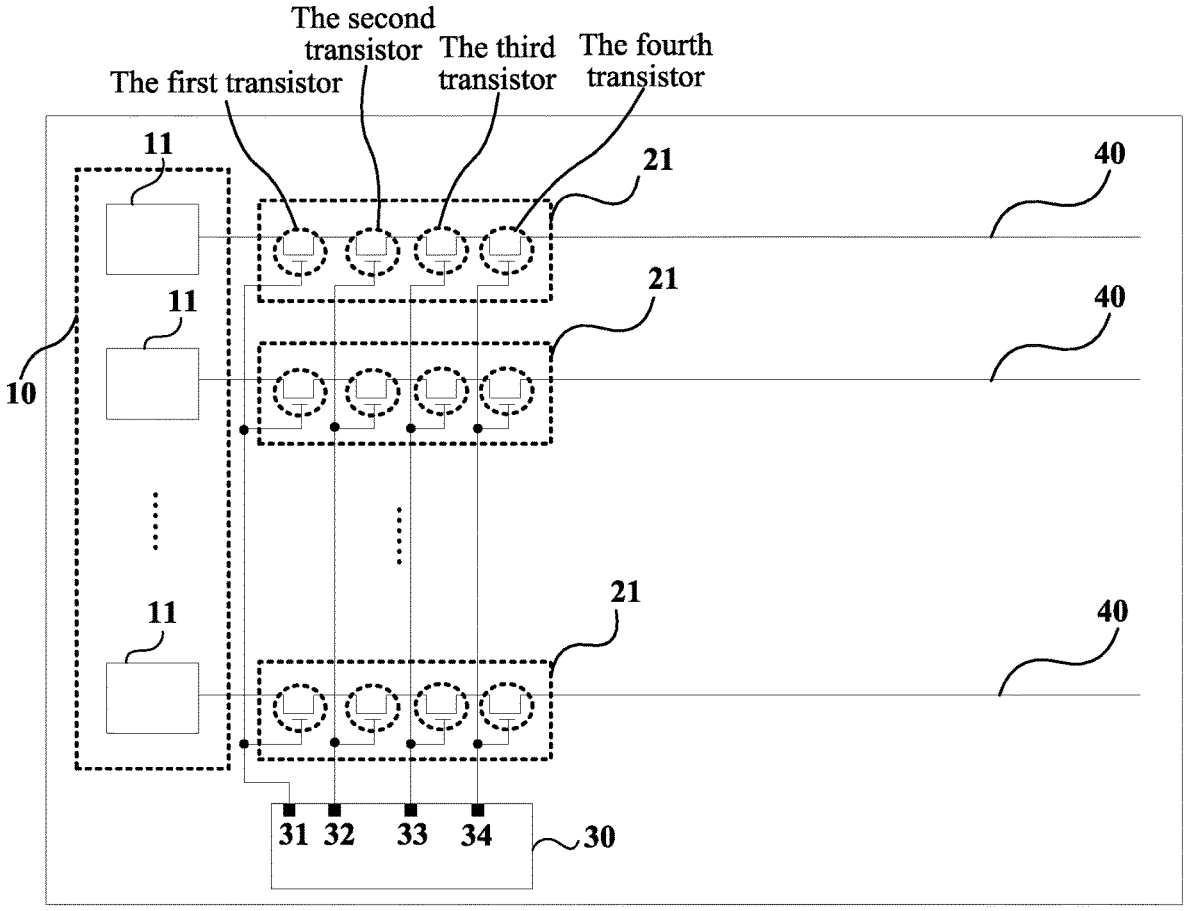
FIG. 2 is a diagram illustrating the structure of another display panel according to an embodiment of the present disclosure.

As shown in FIG. 2, exemplarily, a first impedance regulation subcircuit 21 of each impedance regulation circuit 20 includes four transistors connected in series, that is, N=4. A gate of an i-th transistor of the four transistors in the first impedance regulation subcircuit 21 of the each of the plurality of impedance regulation circuits 20 are electrically connected to a same output terminal of the control module 30. That is, a gate of the first transistor of the four transistors in the first impedance regulation subcircuit 21 of the each impedance regulation circuit 20 is electrically connected to a first output terminal 31 of the control module 30, a gate of the second transistor of the four transistors in the first impedance regulation subcircuit 21 of the each impedance regulation circuit 20 is electrically connected to a second output terminal 32 of the control module 30, a gate of the third transistor of the four transistors in the first impedance regulation subcircuit 21 of the each impedance regulation circuit 20 is electrically connected to a third output terminal 33 of the control module 30, and a gate of the fourth transistor of the four transistors in the first impedance regulation subcircuit 21 of the each impedance regulation circuit 20 is electrically connected to a fourth output terminal 34 of the control module 30.

Since a gate of an i-th transistor of the N transistors in the first impedance regulation subcircuits 21 of the each of the plurality of impedance regulation circuits 20 is electrically connected to a same output terminal of the control module, the control module 30 can simultaneously control the turn-on and turn-off of the i-th transistor in each of a plurality of first impedance regulation subcircuits 21 through the i-th output terminal. In this manner, a number of output terminals in the control module 30 can be reduced, to reduce the cost.

The off-impedances of the plurality of transistors in the first impedance regulation subcircuit 21 may be the same or may be different. For example, transistors having different off-impedances can be obtained by providing the communication width-to-length ratio of the transistors to be different.

Referring to FIG. 2, for example, multiple transistors in multiple impedance regulation subcircuits 21 are N-type transistors as an example. That is, if the control module 30 provides a high level to the transistors, the transistors are turned on; and if the control module 30 provides a low level to the transistors, the transistors are turned off. If all transistors in the first impedance regulation subcircuits 21 are turned off, the impedances of the impedance regulation subcircuits 21 are maximum; and if all transistors in the first impedance regulation subcircuits 21 are turned on, the impedances of the impedance regulation circuits 20 are minimum. Therefore, this embodiment of the present disclosure can adjust the impedances of the impedance regulation circuits 20 through controlling the number of turn-on and turn-off of the transistors in the first impedance regulation subcircuits 21.

TABLE 1

Impedance regulation of an impedance regulation circuit of the display panel shown in FIG. 2

| No. | First Transistor | Second Transistor | Third Transistor | Fourth Transistor | Impedance (kΩ) of Impedance Regulation Circuit |
|---|---|---|---|---|---|
| 1 | 1 | 1 | 1 | 1 | 0 |
| 2 | 1 | 1 | 1 | 0 | 1 |
| 3 | 1 | 1 | 0 | 1 | 2 |
| 4 | 1 | 1 | 0 | 0 | 3 |
| 5 | 1 | 0 | 1 | 1 | 4 |
| 6 | 1 | 0 | 1 | 0 | 5 |
| 7 | 1 | 0 | 0 | 1 | 6 |
| 8 | 1 | 0 | 0 | 0 | 7 |
| 9 | 0 | 1 | 1 | 1 | 8 |
| 10 | 0 | 1 | 1 | 0 | 9 |
| 11 | 0 | 1 | 0 | 1 | 10 |
| 12 | 0 | 1 | 0 | 0 | 11 |
| 13 | 0 | 0 | 1 | 1 | 12 |
| 14 | 0 | 0 | 1 | 0 | 13 |
| 15 | 0 | 0 | 0 | 1 | 14 |
| 16 | 0 | 0 | 0 | 0 | 15 |

Table 1 is an impedance regulation table of an impedance regulation circuit of the display panel shown in FIG. 2. Referring to Table 1, if the off-impedance of the first transistor of the first impedance regulation subcircuit 21 is 1 kΩ, the off-impedance of the second transistor of the first impedance regulation subcircuit 21 is 2 kΩ, the off-impedance of the third transistor of the first impedance regulation subcircuit 21 is 4 kΩ, and the off-impedance of the fourth transistor of the first impedance regulation subcircuit 21 is 8 kΩ there are 16 combinations for controlling the turn-on and turn-off of the transistors in the impedance regulation circuits 20 through the control module 30. In Table 1, the turn-on of the transistor is indicated by 1, and the turn-off of the transistor is indicated by 0. This embodiment of the present disclosure can adjust the impedance of the impedance regulation circuit 20 from 1 kΩ to 15 kΩ.

Table 1 only provides an example of the impedance adjustment of an impedance regulation circuit in conjunction with FIG. 2. In other embodiments, off-impedance values of multiple transistors in the impedance regulation circuit 20 can be set according to actual requirements. For example, off-impedance values of N transistors in the first impedance regulation subcircuit 21 are the same, or off-impedances of at least part of N transistors in the impedance regulation subcircuit 21 are different.

In order to achieve that the impedances of the impedance regulation circuit 20 can be varied at equal intervals, the off-impedances of N transistors in the first impedance regulation subcircuit 21 may be set to be in a geometric sequence. As shown in Table 1, for example, an off-impedance of the first transistor of N transistors in the first impedance regulation subcircuit 21 is 1 kΩ, an off-impedance of the second transistor of N transistors in the first impedance regulation subcircuit 21 is 2 kΩ, an off-impedance of the third transistor of N transistors in the first impedance regulation subcircuit 21 is 4 kΩ, and an off-impedance of the fourth transistor of N transistors in the first impedance regulation subcircuit 21 is 8 kΩ, which can achieve that the impedances of the impedance regulation circuit 20 are adjusted from 0 kΩ to 15 kΩ at equal intervals.

In an embodiment, the control module 30 may be provided to simultaneously control gate potentials of the i-th transistors in the first impedance regulation subcircuits 21 through the i-th output terminals to control the switching degree of the i-th transistors in the first impedance regulation subcircuit 21. As shown in FIG. 2, the first output terminal 31 of the control module 30 controls a gate potential of the first transistor in the first impedance regulation subcircuit 21, the second output terminal 32 of the control module 30 controls a gate potential of the second transistor in the first impedance regulation subcircuit 21, the third output terminal 33 of the control module 30 controls a gate potential of the third transistor in the first impedance regulation subcircuit 21, and the fourth output terminal 34 of the control module 30 controls a gate potential of the fourth transistor in the first impedance regulation subcircuit 21. Each output terminal of the control module 30 outputs an adjustable voltage signal to control the switching degree of the transistor corresponding connected, to achieve the adjustment of the transistor impedance. In this embodiment of the present disclosure, voltage signals control multiple transistors working in the linear region, and different voltage signal values are provided to the gates of the transistors to control the scanning lines 40 to connect to load on-impedance, the output waveform of the scanning pulse signal can be adjusted, to achieve the adjustment of the EMI performance.

Figure 3:
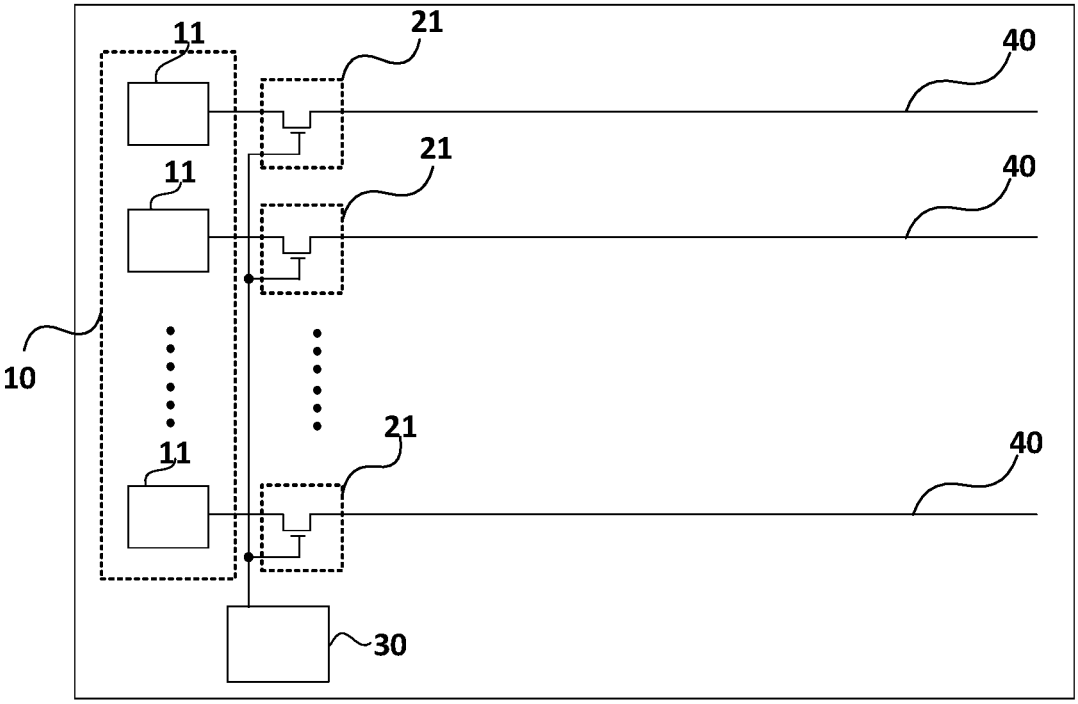
FIG. 3 is a diagram illustrating the structure of another display panel according to an embodiment of the present disclosure.

If the control module 30 outputs the voltage signal to gates of transistors in each impedance regulation circuit 20 to control the switching degree of the transistors, the number of transistors in the impedance regulation circuit 20 can be provided according to the situation. For example, each first impedance regulation subcircuit 21 may include only one transistor, as shown in FIG. 3.

In an embodiment, the control module 30 may further include N cascaded first shift latch modules. Each stage of first shift latch module receives and latches a shift signal output from a previous-stage first shift latch module. The gate of the i-th transistor in each first impedance regulation subcircuit 21 is electrically connected to an i-th-stage first shift latch module.

Figure 4:
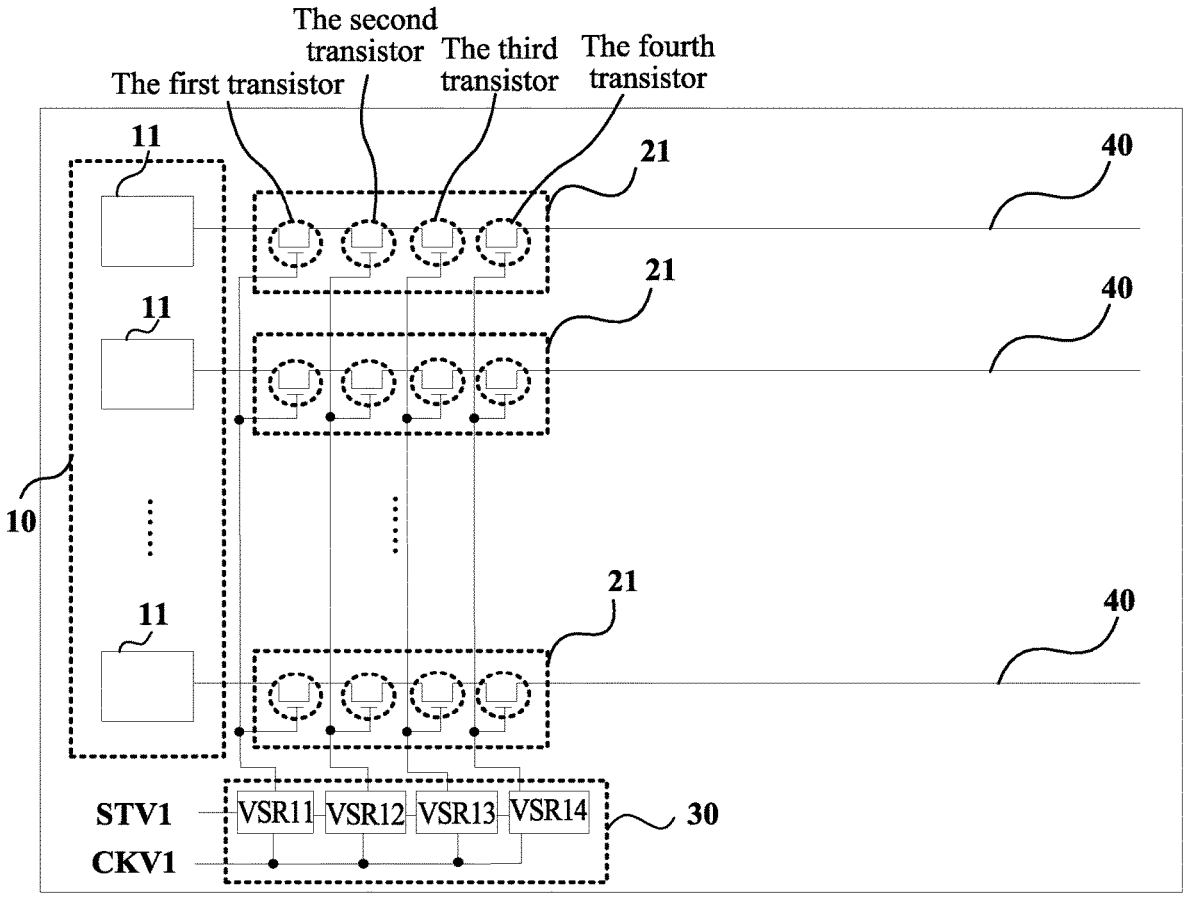
FIG. 4 is a diagram illustrating the structure of another display panel according to an embodiment of the present disclosure.

As shown in FIG. 4, the control module 30 includes four cascaded first shift latch modules VSR1. The four cascaded first shift latch modules VSR1 are respectively a first-stage first shift latch module VSR11, a second-stage first shift latch module VSR12, a third-stage first shift latch module VSR13, and a fourth-stage first shift latch module VSR14. The second-stage first shift latch module VSR12 receives and latches a shift signal output from the first-stage first shift latch module VSR11. The third-stage first shift latch module VSR13 receives and latches a shift signal output from the second-stage first shift latch module VSR12. The fourth-stage first shift latch module VSR14 receives and latches a shift signal output from the third-stage first shift latch module VSR13. A gate of the first transistor in each first impedance regulation subcircuit 21 is electrically connected to the first-stage first shift latch module VSR11. A gate of the second transistor in each first impedance regulation subcircuit 21 is electrically connected to the second-stage first shift latch module VSR12. A gate of the third transistor in each first impedance regulation subcircuit 21 is electrically connected to the third-stage first shift latch module VSR13. A gate of the fourth transistor in each first impedance regulation subcircuit 21 is electrically connected to the fourth-stage first shift latch module VSR14.

In an embodiment, a first-stage first shift latch module includes a first enable signal terminal STV1, and a k-th-stage first shift latch module includes a first shift signal enable terminal. Each stage of first shift latch module includes a first clock signal terminal CKV1 and an output terminal. A first shift signal enable terminal of the k-th-stage first shift latch module is connected to an output terminal of a (k−1)-th-stage first shift latch module. K is a positive integer greater than 1 and less than or equal to N. An output terminal of each stage of first shift latch module outputs a high level or a low level to a transistor gate to control the turn-on and turn-off of a transistor. In addition, an output terminal of the first shift latch module is connected to a first shift signal enable terminal of a next-stage first shift latch module for transmitting a shift signal to the first shift signal enable terminal of the next-stage first shift latch module. The control module 30 controls the impedance of each impedance regulation circuit 20 according to an input signal of the first enable signal terminal STV1 and an input signal of the first clock signal terminal CKV1.

The control module 30 is provided with N cascaded first shift latch modules to control the turn-on or turn-off of transistors in the first impedance regulation subcircuits 21. The input signal of the first enable signal terminal STV1 and the input signal of the first clock signal terminal CKV1 can control the signal state latched by each first shift latch module, and can be output to control the turn-on or turn-off of the transistors in the first impedance regulation subcircuits 21.

For example, in a frame of image period, the input signal of the first enable signal terminal STV1 remain a high level, and latch states of multi-stage first shift latch module of the control module 30 are 1, 1, 1, 1 in order. That is, all first shift latch modules from the first stage to the fourth stage output high levels to the transistors in the first impedance regulation subcircuits 21, and the transistors are controlled in a turn-on state. In this case, the impedances of the impedance regulation circuits 20 are minimum, the rising edge and falling edge of the scanning pulse signal are the steepest, and the electromagnetic interference is the strongest.

In a frame of image period, if the input signal of the first enable signal terminal STV1 remains a low level, the latch states of the multi-stage first shift latch module of the control module 30 are 0, 0, 0, 0 in order. That is, all first shift latch modules from the first stage to the fourth stage output low levels to the transistors in the first impedance regulation subcircuits 21, and the transistors are controlled in a turn-off state. In this case, the impedances of the plurality of impedance regulation circuits 20 are maximum, the rising edge and falling edge of the scanning pulse signal are the slowest, and the electromagnetic interference is the smallest.

Figure 5:
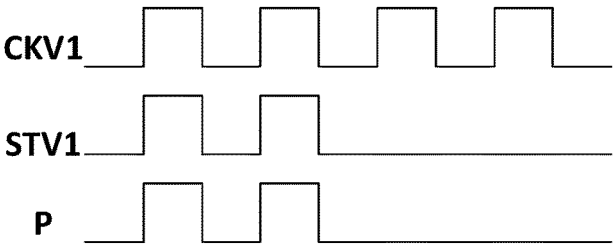
FIG. 5 is a diagram illustrating the control timing of a first shift latch module in a control module according to an embodiment of the present disclosure.

Therefore, in this embodiment of the present disclosure, by selecting the waveform of the input signal of the first enable signal terminal STV1, the combination of turn-on and turn-off of the transistors in the plurality of first impedance regulation subcircuits 21 can be achieved under the control of the input signal of the first clock signal terminal CKV1, to adjust the waveform of the scanning pulse signal according to the EMI requirements of different products. For example, FIG. 5 is a diagram illustrating the control timing of a first shift latch module in a control module according to an embodiment of the present disclosure. As shown in FIG. 5, the first enable signal STV1 is a high level only in the first two pulses of the first clock signal CKV1 in a frame of image period. Latch states P of the multi-stage first shift latch module of the control module 30 are 1, 1, 0, 0 in order. That is, the first-stage first shift latch module outputs a high level to the first transistor in the first impedance regulation subcircuit 21, the second-stage first shift latch module outputs a high level to the second transistor in the first impedance regulation subcircuit 21, the third-stage first shift latch module outputs a low level to the third transistor in the first impedance regulation subcircuit 21, and the fourth-stage first shift latch module outputs a low level to the fourth transistor in the first impedance regulation subcircuit 21. The first transistor in the first impedance regulation subcircuit 21 is in an on state, the second transistor in the first impedance regulation subcircuit 21 is in an on state, the third transistor in the first impedance regulation subcircuit 21 is in an off state, and the fourth transistor in the first impedance regulation subcircuit 21 is in an off state. In this case, the impedances of the impedance regulation circuits 20 are interposed between the all-on of transistors in the impedance regulation circuits 20 and the all-off of transistors in the impedance regulation circuits 20.

The larger the impedances of the impedance regulation circuits 20 are, the slower the rising edge and falling edge of the scanning pulse signal are, and the smaller the electromagnetic interference is, but the longer the delay of the scanning pulse signal is. The delay of the scanning pulse signal is too long, which easily affects the display effect of the display panel. Therefore, in the practical application process, the electromagnetic interference and the delay of the scanning pulse signal need to be simultaneously considered according to the actual requirements of products.

Figure 6:
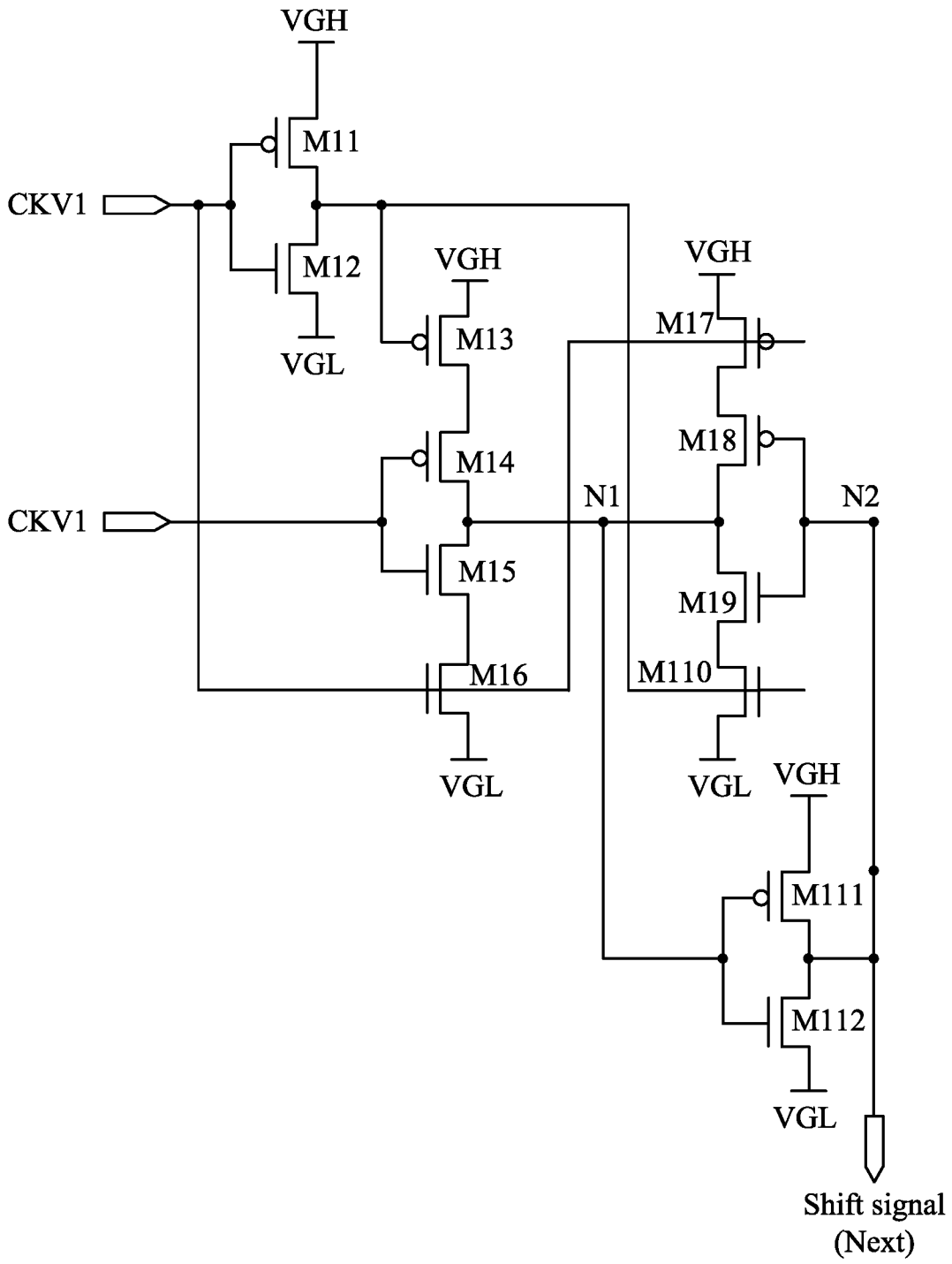
FIG. 6 is a diagram illustrating the circuit structure of a first shift latch module according to an embodiment of the present disclosure.

This embodiment of the present disclosure does not limit the circuit structure of the first shift latch module as long as the latch function described in above embodiments can be achieved. In an embodiment, this embodiment of the present disclosure provides a circuit structure of a first shift latch module. The first shift latch module may consist of a corresponding active device or passive device. As shown in FIG. 6, for example, the first shift latch module may consist of a first inverter (M11 and M12), a second inverter (M111 and M12), and eight transistors (M13, M14, M15, M16, M17, M18, M19, and M110). Channel types of the transistors M11 and M12 of the first inverter are different, gates of the transistors M11 and M12 are input terminals of the first inverter, and second electrodes of the transistors M11 and M12 are output terminals of the first inverter. Channel types of the transistors M111 and M112 of the second inverter are different, gates of the transistors M111 and M112 are input terminals of the second inverter, and second electrodes of the transistors M111 and M112 are output terminals of the second inverter. Channel types of the transistors M13, M14, M17, and M18 may be the same as that of the transistor M11, and channel types of the transistors M15, M16, M19, and M110 may be the same as that of the transistor M12.

An input terminal of the first inverter, a gate of the transistor M16 and a gate of the transistor M17 are each electrically connected to the first clock signal terminal CKV1, and a gate of the transistor M13 and a gate of the transistor M110 are each electrically connected to the output terminal of the first inverter. A first electrode of the transistor M11, a first electrode of the transistor M13, a first electrode of the transistor M17, and a first electrode of the transistor M111 are each electrically connected to a first level signal input terminal VGH, and a first electrode of the transistor M12, a first electrode of the transistor M16, a first electrode of the transistor M110, and a first electrode of the transistor M112 are each electrically connected to a second level signal input terminal VGL. A second electrode of the transistor M13 is electrically connected to a first electrode of the transistor M14, a second electrode of the transistor M14 and a second electrode of the transistor M15 are each electrically connected to a first node N1, and a gate of the transistor M14 and a gate of the transistor M15 are each electrically connected to the first enable signal terminal STV1 (or the first shift signal enable terminal). A first electrode of the transistor M15 is electrically connected to a second electrode of the transistor M16. A second electrode of the transistor M17 is electrically connected to a first electrode of the transistor M18. A second electrode of the transistor M18 and a second electrode of the transistor M19 are each electrically connected to the first node N1, and a gate of the transistor M18, a gate of the transistor M19, and the output terminals of the second inverter are each electrically connected to a second node N2. A first electrode of the transistor M19 is electrically connected to a second electrode of the transistor M110. An input terminal of the second inverter is electrically connected to the first node N1. The second node N2 is connected to an output terminal Next of the first shift latch module.

In the following, the transistors M11, M13, M14, M17, M18 and M111 are P-type transistors, and M12, M15, M16, M19, M110, and M112 are N-type transistors as examples, and the driving process of the first shift latch module is described as follows. The first clock signal input terminal CKV1 receives a first clock control signal CKV1 of the high level controlling the transistor M16 to be turned on. The first enable signal terminal STV1 (or the first shift signal enable terminal) receives the high level controlling the transistor M15 to be turned on. A second level signal of the low level received by the second level signal input terminal VGL is written into the first node N1 sequentially through the transistors M15 and M16 which are turned on, so that the input terminal of the second inverter electrically connected to the first node N1 inputs the second level signal of the low level. In this case, the output terminal of the second inverter outputs the first level signal of the high level received by the first level signal input terminal VGH to the second node N2. The output terminal Next of the first shift latch module electrically connected to the second node N2 outputs a shift signal Next of the high level.

In an embodiment, each impedance regulation circuit 20 may further include a second impedance regulation subcircuit. The second impedance regulation subcircuit includes M transistors connected in parallel. The Gate of a j-th transistor of the M transistors in the second impedance regulation subcircuit of each impedance regulation circuit 20 is electrically connected to a same output terminal of the control module 30. M is a positive integer greater than 1, and j is a positive integer less than or equal to M.

In the solution where multiple transistors in the second impedance regulation subcircuit are connected in parallel, the transistors may correspond to a resistor having an impedance when turned on. The resistor is infinite when the transistors are turned off. This embodiment of the present disclosure may use on-impedances of the transistors in the second impedance regulation subcircuit to achieve the adjustment of the impedances of the impedance regulation circuits 20. The output terminal of the control module 30 may output different level signals to control the turn-on or turn-off of the plurality of transistors in the second impedance regulation subcircuit. For example, a transistor having a relatively small channel width-to-length ratio may be selected so that the channel is completely pinched off and the resistor is infinite when the transistor is turned off, and the transistor is equivalent to a resistor when the transistor is turned on.

Figure 7:
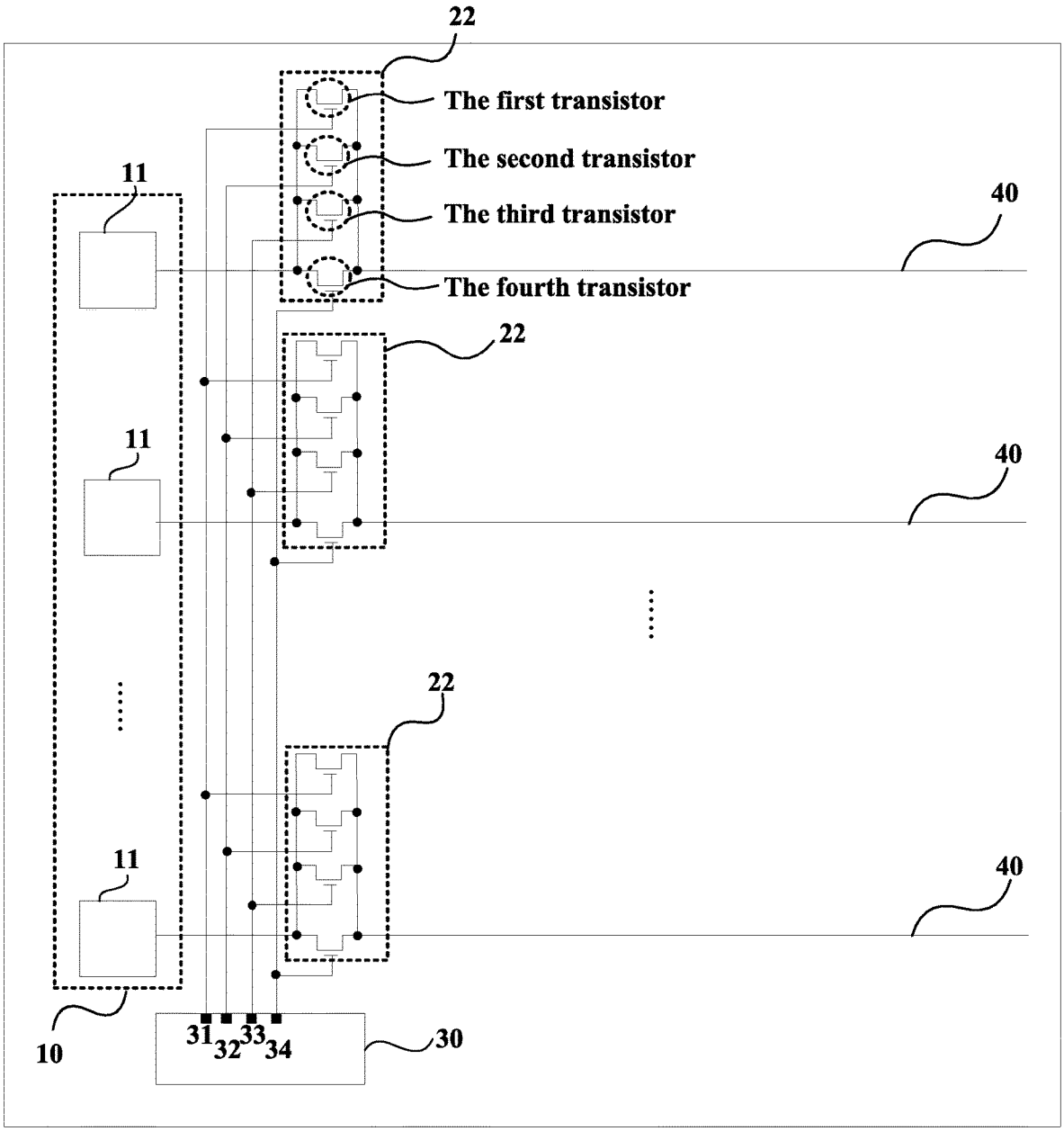
FIG. 7 is a diagram illustrating the structure of another display panel according to an embodiment of the present disclosure.

FIG. 7 is a diagram illustrating the structure of another display panel according to an embodiment of the present disclosure. As shown in FIG. 7, each impedance regulation circuit 20 includes a second impedance regulation subcircuit 22. The second impedance regulation subcircuit 22 includes four transistors connected in parallel. A gate of the first transistor in each second impedance regulation subcircuit 22 is electrically connected to the first output terminal 31 of the control module 30. A gate of the second transistor in each second impedance regulation subcircuit 22 is electrically connected to the second output terminal 32 of the control module 30. A gate of the third transistor in each second impedance regulation subcircuit 22 is electrically connected to the third output terminal 33 of the control module 30. A gate of the fourth transistor in each second impedance regulation subcircuit 22 is electrically connected to the fourth output terminal 34 of the control module 30. Since a gate of a j-th transistor of four transistors in each second impedance regulation subcircuit 22 are electrically connected to a same output terminal of the control module 30, the control module 30 can simultaneously control the turn-on and turn-off of the j-th transistor in each second impedance regulation subcircuit 22 through the i-th output terminal. In this manner, the number of output terminals in the control module 30 can be reduced, to reduce the cost.

On-impedances of M transistors connected in parallel may be the same or different. For example, transistors having different on-impedances can be obtained by providing the communication width-to-length ratio of the transistors to be different.

Table 2 is an impedance regulation table of an impedance regulation circuit of the display panel shown in FIG. 7. Referring to Table 2, if the on-impedances of the first transistor to the fourth transistor of the second impedance regulation subcircuit 22 each are 1 kΩ, there are sixteen combinations for controlling the turn-on and turn-off of the transistors in the second impedance regulation subcircuit 22 through the control module 30. In Table 2, the turn-on of the transistor is indicated by 1, and the turn-off of the transistor is indicated by 0.

TABLE 2

Impedance regulation of an impedance regulation circuit of the display panel shown in FIG. 7

| No. | First Transistor | Second Transistor | Third Transistor | Fourth Transistor | Impedance (kΩ) of Impedance Regulation Circuit |
|---|---|---|---|---|---|
| 1 | 1 | 1 | 1 | 1 | 0.25 |
| 2 | 1 | 1 | 1 | 0 | 0.33 |
| 3 | 1 | 1 | 0 | 1 | 0.33 |
| 4 | 1 | 1 | 0 | 0 | 0.5 |
| 5 | 1 | 0 | 1 | 1 | 0.33 |
| 6 | 1 | 0 | 1 | 0 | 0.5 |
| 7 | 1 | 0 | 0 | 1 | 0.5 |
| 8 | 1 | 0 | 0 | 0 | 1 |
| 9 | 0 | 1 | 1 | 1 | 0.33 |
| 10 | 0 | 1 | 1 | 0 | 0.5 |
| 11 | 0 | 1 | 0 | 1 | 0.5 |
| 12 | 0 | 1 | 0 | 0 | 1 |
| 13 | 0 | 0 | 1 | 1 | 0.5 |
| 14 | 0 | 0 | 1 | 0 | 1 |
| 15 | 0 | 0 | 0 | 1 | 1 |
| 16 | 0 | 0 | 0 | 0 | ∞ |

As can be seen from the data in Table 2, compared with the transistors connected in series in the plurality of first impedance regulation subcircuit 21, the impedance regulation circuit 20 of the second impedance regulation subcircuit 22 in which the transistors connected in parallel has a smaller impedance adjustment range but high precision, which is more suitable for the EMI performance fine adjustment scenario. The transistors connected in series in the plurality of first impedance regulation subcircuit 21 are suitable for the EMI performance coarse adjustment scenario.

Table 2 only provides an example of the impedance adjustment of an impedance regulation circuit in conjunction with FIG. 7. In other embodiments, on-impedance values of a plurality of transistors in the second impedance regulation subcircuit 22 can be set according to actual requirements. For example, on-impedance values of M transistors in the second impedance regulation subcircuit 22 are the same, or on-impedances of at least part of M transistors of the second impedance regulation subcircuit 22 are different.

In an embodiment, the control module 30 may be provided to simultaneously control gate potentials of the j-th transistors of M transistors in multiple second impedance regulation subcircuits 22 through the j-th output terminals to control the switching degree of the j-th transistors in the multiple second impedance regulation subcircuits 22. As shown in FIG. 7, the first output terminal 31 of the control module 30 controls a gate potential of the first transistor of M transistors in each second impedance regulation subcircuit 22, the second output terminal 32 of the control module 30 controls a gate potential of the second transistor of M transistors in each second impedance regulation subcircuit 22, the third output terminal 33 of the control module 30 controls a gate potential of the third transistor of M transistors in each second impedance regulation subcircuit 22, and the fourth output terminal 34 of the control module 30 controls a gate potential of the fourth transistor of M transistors in each second impedance regulation subcircuit 22. Each output terminal of the control module 30 outputs an adjustable voltage signal to control the switching degree of the transistor corresponding connected, to achieve the adjustment of the transistor impedance. In this embodiment of the present disclosure, the voltage signal control multiple transistors working in the linear region, and different voltage signal values are provided to the gates of the transistors to control the scanning lines 40 to connect to load on-impedance, so that the output waveform of the scanning pulse signal can be adjusted In an embodiment, in this embodiment of the present disclosure, the control module 30 may further include M cascaded second shift latch modules. Each stage of second shift latch module receives and latches a shift signal output from a previous-stage second shift latch module. The gate of the j-th transistor in each second impedance regulation subcircuit 22 is electrically connected to a j-th-stage second shift latch module.

Figure 8:
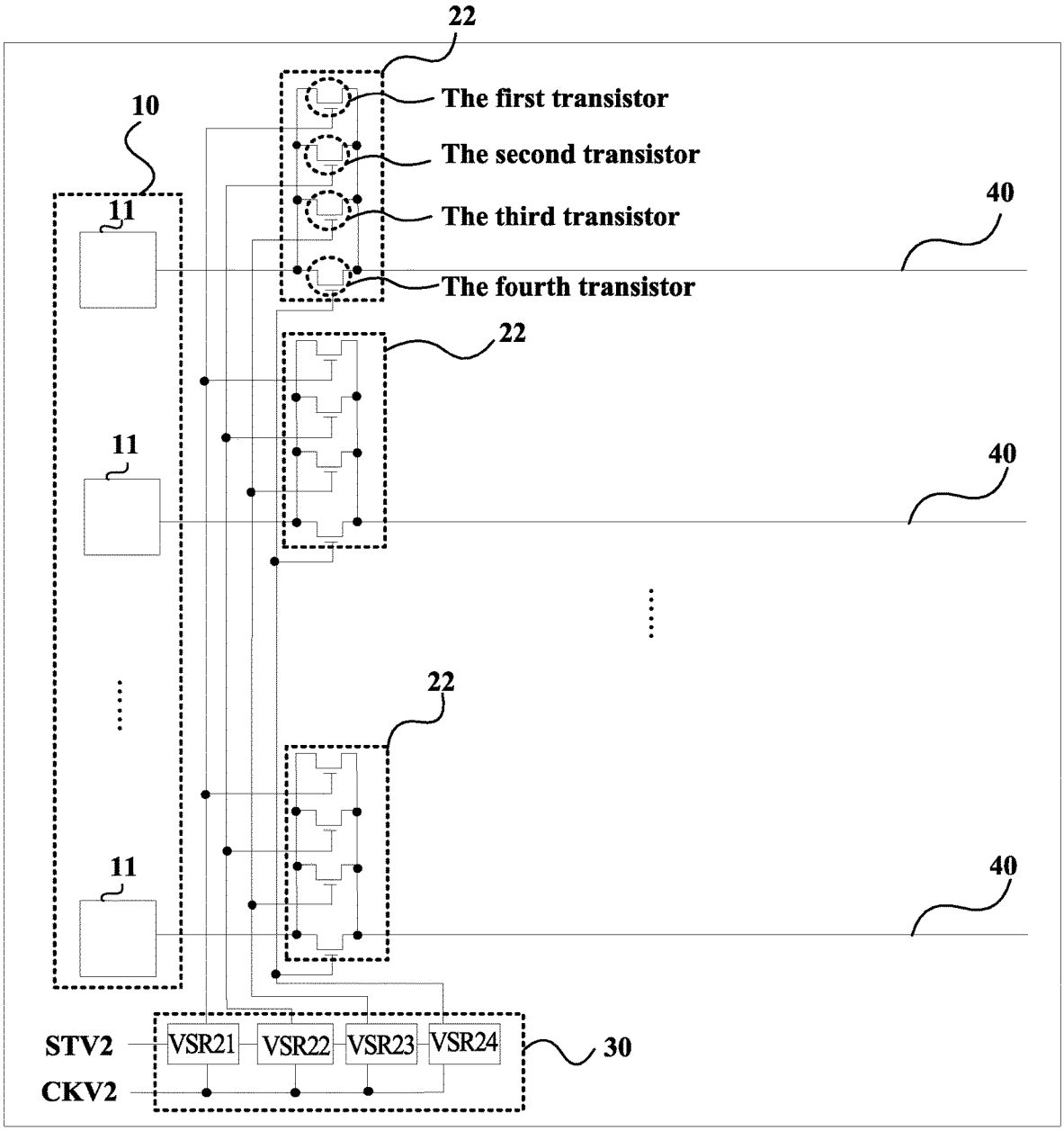
FIG. 8 is a diagram illustrating the structure of another display panel according to an embodiment of the present disclosure.

As shown in FIG. 8, the control module 30 includes four cascaded second shift latch modules VSR2. Four cascaded second shift latch modules VSR1 are respectively a first-stage second shift latch module VSR21, a second-stage second shift latch module VSR22, a third-stage second shift latch module VSR23, and a fourth-stage second shift latch module VSR24. The second-stage second shift latch module VSR22 receives and latches a shift signal output from the first-stage second shift latch module VSR21. The third-stage second shift latch module VSR23 receives and latches a shift signal output from the second-stage second shift latch module VSR22. The fourth-stage second shift latch module VSR24 receives and latches a shift signal output from the third-stage second shift latch module VSR23. A gate of the first transistor in each second impedance regulation subcircuit 22 is electrically connected to the first-stage second shift latch module VSR21. A gate of the second transistor in each second impedance regulation subcircuit 22 is electrically connected to the second-stage second shift latch module VSR22. A gate of the third transistor in each second impedance regulation subcircuit 22 is electrically connected to the third-stage second shift latch module VSR23. A gate of the fourth transistor in each second impedance regulation subcircuit 22 is electrically connected to the fourth-stage second shift latch module VSR24.

Optionally, a first-stage second shift latch module includes a second enable signal terminal STV2, and a x-th-stage second shift latch module includes a second shift signal enable terminal. Each stage of second shift latch module of the four cascaded second shift latch modules includes a second clock signal terminal CKV2 and an output terminal. The second shift signal enable terminal of an x-th-stage second shift latch module is connected to an output terminal of a x−1-th-stage second shift latch module. x is a positive integer greater than 1 and less than or equal to M. An output terminal of each stage of second shift latch module of the four cascaded second shift latch modules outputs a high level or a low level to the transistor gate to control the turn-on and turn-off of the transistor. In addition, an output terminal of the second shift latch module is connected to a second shift signal enable terminal of a next-stage second shift latch module for transmitting a shift signal to the second shift signal enable terminal of the next-stage second shift latch module. The control module 30 controls the impedance of each impedance regulation circuit 20 according to an input signal of the second enable signal terminal STV2 and an input signal of the second clock signal terminal CKV2.

The control module 30 is provided with M cascaded second shift latch modules to control the turn-on or turn-off of the transistors in the second impedance regulation subcircuits 22. The input signal of the second enable signal terminal STV2 and the input signal of the second clock signal terminal CKV2 can control the signal state latched by each second shift latch module, and can be output to control the turn-on or turn-off of the transistors in the second impedance regulation subcircuits 22.

The latch output working principle of M cascaded second shift latch modules is similar to the latch output working principle of N cascaded first shift latch modules. The second shift latch module may also refer to the circuit structure shown in FIG. 6. The latch output working principle of M cascaded second shift latch modules is not repeated here.

Figure 9:
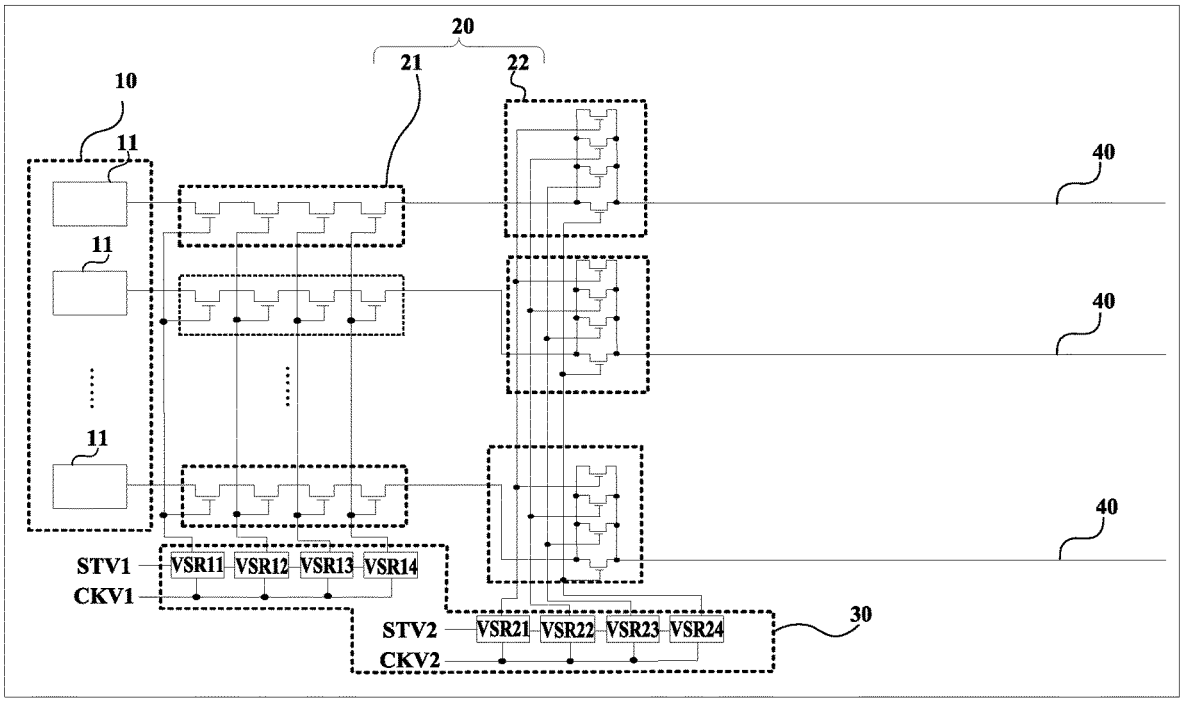
FIG. 9 is a diagram illustrating the structure of another display panel according to an embodiment of the present disclosure.

In an embodiment, the impedance regulation circuits 20 in this embodiment of the present disclosure may employ a solution in which transistors are connected in parallel and a solution in which transistors are connected in series at the same time. As shown in FIG. 9, each impedance regulation circuit 20 includes the first impedance regulation subcircuit 21 and the second impedance regulation subcircuit 22. The first impedance regulation subcircuit 21 includes N transistors connected in series. All gates of the i-th transistors in the first impedance regulation subcircuits 21 of multiple impedance regulation circuits are electrically connected to a same output terminal of the control module 30. In FIG. 9, exemplarily, N is 4. The second impedance regulation subcircuit 22 includes M transistors connected in parallel. All gates of the j-th transistors in the second impedance regulation subcircuits 22 of multiple impedance regulation circuits 20 are electrically connected to a same output terminal of the control module 30. In FIG. 9, exemplarily, M is 4.

Figure 10:
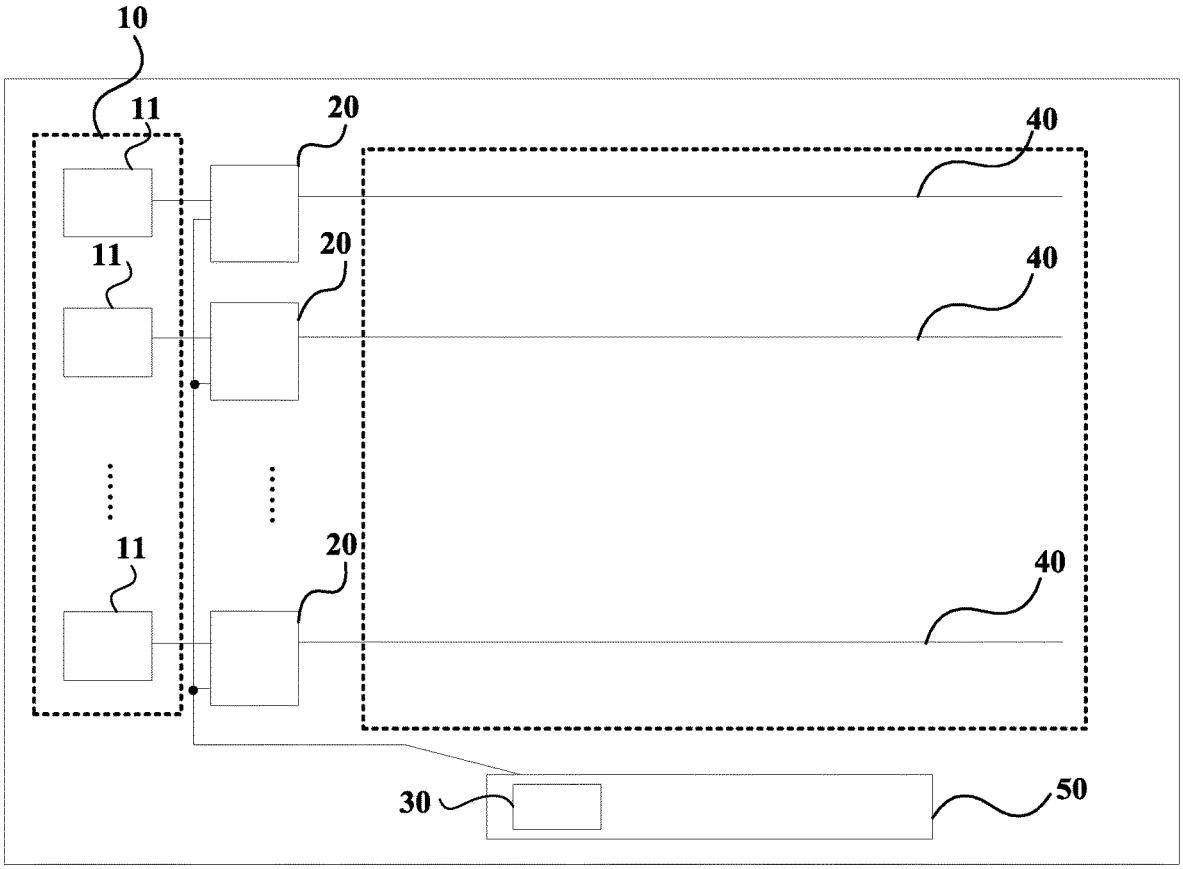
FIG. 10 is a diagram illustrating the structure of another display panel according to an embodiment of the present disclosure.

In an embodiment, as shown in FIG. 10, the display panel according to this embodiment of the present disclosure further includes a driver chip 50. The control module 30 is integrated within the driver chip 50. This embodiment of the present disclosure may adjust impedances of multiple transistors in the impedance regulation circuits 20 directly through the driver chip 50, such as controlling each transistor in the impedance regulation circuit 20 to be turned on or off, or controlling the gate potential of each transistor in the impedance regulation circuit 20 to adjust the switching degree of each transistor.

Figure 11:
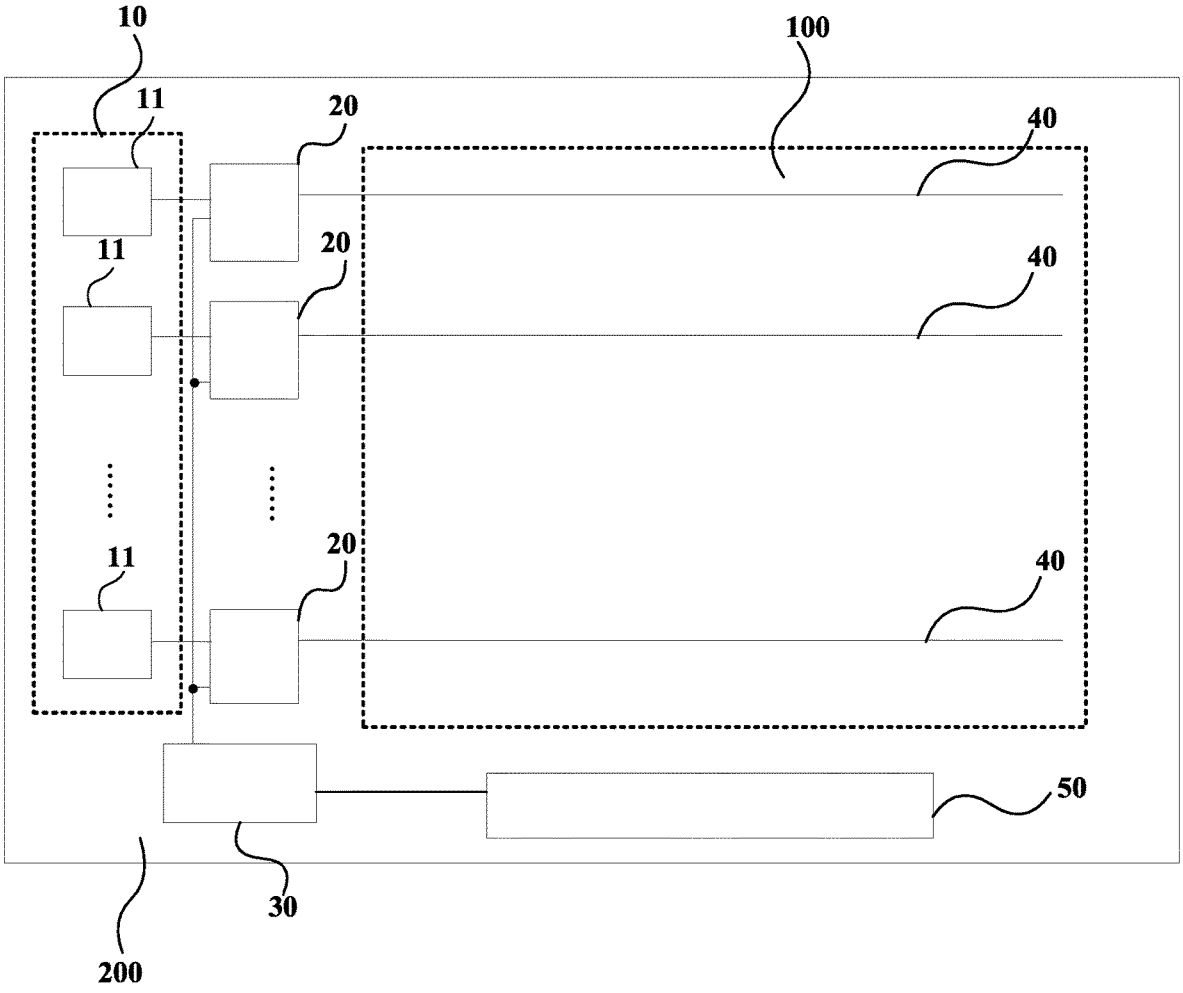
FIG. 11 is a diagram illustrating the structure of another display panel according to an embodiment of the present disclosure.

In other embodiments, this embodiment of the present disclosure may also provide the control module 30 in a non-display region of the display panel. As shown in FIG. 11, the display panel includes a display region 100 and a non-display region 200 surrounding the display region 100. The control module 30 is located in the non-display region 200. The display panel further includes the driver chip 50. The driver chip 50 is electrically connected to the control module 30. The driver chip 50 is configured to drive the control module 30 to adjust the impedances of the transistors in the impedance regulation circuits 20.

For convenience of description, a signal terminal and a signal transmitted by the signal terminal are denoted by the same reference numeral. For example, the first enable signal terminal and the first enable signal are each denoted by STV1, and the first clock signal terminal and the first clock signal each are denoted by CKV1.

Figure 12:
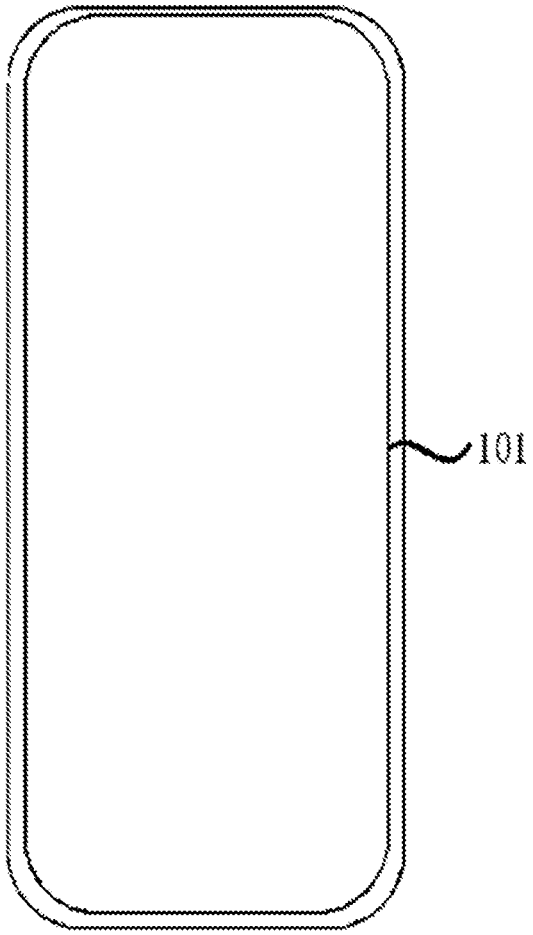
FIG. 12 is a view illustrating the structure of a display device according to an embodiment of the present disclosure.

This embodiment of the present disclosure further provides a display device. The display device includes the display panel described in any embodiment of the present disclosure. Therefore, the display device according to this embodiment of the present disclosure has corresponding effects of the display panel according to this embodiment of the present disclosure, which is not repeated here. In an embodiment, the display device may be a mobile phone, a computer, a smart wearable device (for example, a smart watch), an onboard display device, and other electronic devices, which is not limited in this embodiment of the present disclosure. In an embodiment, FIG. 12 is a view illustrating the structure of a display device according to this embodiment of the present disclosure. As shown in FIG. 12, the display device includes the display panel 101 in the above-described embodiment.

In the display panel and the display device according to this embodiment of the present disclosure, the plurality of impedance regulation circuits 20 are in series connection with the each stage of first shift register 11 in the gate drive circuit, and the impedances of the plurality of transistors in the plurality of impedance regulation circuits 20 are adjusted by the control module 30. The output waveform of the gate drive circuit is adjusted according to different EMI requirement standards of the electronic products integrated with the display panel to configure optimal EMI performance for the electronic products with different EMI requirement standards.

What is claimed is:

1. A display panel for adjusting impedance, comprising:

a gate drive circuit comprising a plurality of cascaded first shift registers, wherein the plurality of cascaded first shift registers are electrically connected to a plurality of scanning lines in one to one correspondence and each stage of the plurality of cascaded first shift registers is configured to provide a scanning pulse signal to a scanning line correspondingly connected;

a plurality of impedance regulation circuits in one-to-one correspondence with the plurality of scanning lines, wherein each of the plurality of impedance regulation circuits is in series connection between a first shift register corresponding to the each of the plurality of impedance regulation circuits and a scanning line corresponding to the each of the plurality of impedance regulation circuits; and the each of the plurality of impedance regulation circuits comprises at least one transistor; and a control module electrically connected to the plurality of impedance regulation circuits and configured to adjust an impedance of the at least one transistor in the each of the plurality of impedance regulation circuits.

2. The display panel for adjusting impedance according to claim 1, wherein the control module is configured to control turn-on and turn-off of the at least one transistor in the each of the plurality of impedance regulation circuits to adjust the impedance of the at least one transistor in the each of the plurality of impedance regulation circuits.

3. The display panel for adjusting impedance according to claim 1, wherein the control module is configured to adjust a gate voltage value of the at least one transistor in the each of the plurality of impedance regulation circuits to adjust the impedance of the at least one transistor in the each of the plurality of impedance regulation circuits.

4. The display panel for adjusting impedance according to claim 1, wherein the each of the plurality of impedance regulation circuits comprises a first impedance regulation subcircuit, and the first impedance regulation subcircuit comprises N transistors connected in series; and a gate of an i-th transistor of the N transistors in the first impedance regulation subcircuit of the each of the plurality of impedance regulation circuits is electrically connected to a same output terminal of the control module, wherein N is a positive integer greater than 1, and i is a positive integer less than or equal to N.

5. The display panel for adjusting impedance according to claim 4, wherein the control module comprises N cascaded first shift latch modules; and each stage of first shift latch module of the N cascaded first shift latch modules receives and latches a shift signal output from a previous-stage first shift latch module of the N cascaded first shift latch modules; and the gate of the i-th transistor of the N transistors in the first impedance regulation subcircuit of the each of the plurality of impedance regulation circuits is electrically connected to an i-th-stage first shift latch module of the N cascaded first shift latch modules.

6. The display panel for adjusting impedance according to claim 5, wherein a first-stage first shift latch module of the N cascaded first shift latch modules comprises a first enable signal terminal; a k-th-stage first shift latch module of the N cascaded first shift latch modules comprises a first shift signal enable terminal; the each stage of first shift latch module of the N cascaded first shift latch modules comprises a first clock signal terminal and an output terminal; and the control module is configured to control an impedance of the each of the plurality of impedance regulation circuits according to an input signal of the first enable signal terminal and an input signal of the first clock signal terminal of the each stage of first shift latch module, and the first shift signal enable terminal of the k-th-stage first shift latch module of the N cascaded first shift latch modules is connected to an output terminal of a (k−1)-th-stage first shift latch module of the N cascaded first shift latch modules, wherein K is a positive integer greater than 1 and less than or equal to N.

7. The display panel for adjusting impedance according to claim 4, wherein off-impedances of at least part of the N transistors in the first impedance regulation subcircuit of the each of the plurality of impedance regulation circuits are different.

8. The display panel for adjusting impedance according to claim 7, wherein off-impedances of the N transistors in the first impedance regulation subcircuit of the each of the plurality of impedance regulation circuits are in a geometric sequence.

9. The display panel for adjusting impedance according to claim 1, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

10. The display panel for adjusting impedance according to claim 9, wherein the control module comprises M cascaded second shift latch modules; and each stage of second shift latch module of the M cascaded second shift latch modules receives and latches a shift signal output from a previous-stage second shift latch module of the M cascaded second shift latch modules; and the gate of the j-th transistor of the M transistors in the second impedance regulation subcircuit of the each of the plurality of impedance regulation circuits is electrically connected to a j-th-stage second shift latch module of the M cascaded second shift latch modules.

11. The display panel for adjusting impedance according to claim 10, wherein a first-stage second shift latch module of the M cascaded second shift latch modules comprises a second enable signal terminal; an x-th-stage second shift latch module of the M cascaded second shift latch modules comprises a second shift signal enable terminal; the each stage of second shift latch module of the M cascaded second shift latch modules comprises a second clock signal terminal and an output terminal; and the control module is configured to control impedance of the each of the plurality of impedance regulation circuits according to an input signal of the second enable signal terminal and an input signal of the second clock signal terminal of the each stage of second shift latch module, and the second shift signal enable terminal of the x-th-stage second shift latch module is connected to an output terminal of an (x−1)-th-stage second shift latch module of the M cascaded second shift latch modules, wherein x is a positive integer greater than 1 and less than or equal to M.

12. The display panel for adjusting impedance according to claim 9, wherein on-impedances of the M transistors in the second impedance regulation subcircuit of the each of the plurality of impedance regulation circuits are the same.

13. The display panel for adjusting impedance according to claim 1, further comprising a driver chip, and the control module is integrated in the driver chip.

14. The display panel for adjusting impedance according to claim 1, further comprising a display region and a non-display region surrounding the display region, and the control module is located in the non-display region; and the display panel further comprises a driver chip, the driver chip is electrically connected to the control module, and the driver chip is configured to drive the control module to adjust the impedance of the at least one transistor in the each of the plurality of impedance regulation circuits.

15. A display device for adjusting impedance, comprising a display panel for adjusting impedance, wherein the display panel for adjusting impedance comprises:

a gate drive circuit comprising a plurality of cascaded first shift registers, wherein the plurality of cascaded first shift registers are electrically connected to a plurality of scanning lines in one to one correspondence and each stage of the plurality of cascaded first shift registers is configured to provide a scanning pulse signal to a scanning line correspondingly connected;

a plurality of impedance regulation circuits in one-to-one correspondence with the plurality of scanning lines, wherein each of the plurality of impedance regulation circuits is in series connection between a first shift register corresponding to the each of the plurality of impedance regulation circuits and a scanning line corresponding to the each of the plurality of impedance regulation circuits; and the each of the plurality of impedance regulation circuits comprises at least one transistor; and a control module electrically connected to the plurality of impedance regulation circuits and configured to adjust an impedance of the at least one transistor in the each of the plurality of impedance regulation circuits.

16. The display panel for adjusting impedance according to claim 2, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

17. The display panel for adjusting impedance according to claim 3, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

18. The display panel for adjusting impedance according to claim 4, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

19. The display panel for adjusting impedance according to claim 5, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

20. The display panel for adjusting impedance according to claim 6, wherein the each of the plurality of impedance regulation circuits comprises a second impedance regulation subcircuit, and the second impedance regulation subcircuit comprises M transistors connected in parallel; and a gate of a j-th transistor of the M transistors in the second impedance regulation subcircuit of the each of the plurality of impedance regulation circuits is electrically connected to a same output terminal of the control module, wherein M is a positive integer greater than 1, and j is a positive integer less than or equal to M.

* * * * *